US007096517B2

(12) United States Patent
Gübeli et al.

(10) Patent No.: US 7,096,517 B2
(45) Date of Patent: Aug. 29, 2006

(54) FLUSHING DEVICE FOR A LAVATORY

(75) Inventors: Albert Gübeli, Rapperswil (CH); Mario Von Ballmoos, Jona (CH)

(73) Assignee: Geberit Technik AG, Jona (CH)

( * ) Notice: Subject to any disclaimer, the term of this patent is extended or adjusted under 35 U.S.C. 154(b) by 274 days.

(21) Appl. No.: 10/472,781

(22) PCT Filed: Mar. 21, 2002

(86) PCT No.: PCT/CH02/00167

§ 371 (c)(1),
(2), (4) Date: Mar. 12, 2004

(87) PCT Pub. No.: WO02/077377

PCT Pub. Date: Oct. 3, 2002

(65) Prior Publication Data

US 2004/0128753 A1 Jul. 8, 2004

(30) Foreign Application Priority Data

Mar. 26, 2001 (CH) ..... 544-01

(51) Int. Cl.
*E03D 3/10* (2006.01)

(52) U.S. Cl. ..... 4/354; 4/405

(58) Field of Classification Search ..... 4/354, 4/359–362, 405, 410

See application file for complete search history.

(56) References Cited

U.S. PATENT DOCUMENTS 2,868,493 A 1/1959 Gray
2,957,181 A 10/1960 Lamping
5,005,226 A 4/1991 Basile et al.
5,136,732 A 8/1992 Andersson
5,386,596 A 2/1995 Hennessy
5,406,652 A * 4/1995 Hennessy ..... 4/354
6,457,187 B1 * 10/2002 Andersson et al. ..... 4/359

FOREIGN PATENT DOCUMENTS

FR 2732379 A1 10/1996
WO WO 95/04196 A1 2/1995
WO WO 98/39522 A1 9/1998

* cited by examiner

*Primary Examiner*—Charles E. Phillips
(74) *Attorney, Agent, or Firm*—Sughrue Mion, PLLC

(57) ABSTRACT

A flushing device includes a cistern, in which at least one pressure chamber is arranged with a supply line for water and a discharge valve. At least part of the flushing water may be pressurised in the pressure chamber and may be discharged for flushing through the discharge valve. At least one pressure cylinder unit is provided, in which the flushing water may be pressurised and discharged for flushing, by means of a spring-loaded pressure piston. The pressure piston is preferably held in a starting position and may be released for a flushing execution. Should two pressure cylinder units be provided, either a partial or a complete flushing operation may be selected.

15 Claims, 3 Drawing Sheets

FLUSHING DEVICE FOR A LAVATORY

BACKGROUND OF THE INVENTION

1. Field of the Invention

The invention relates to a flushing device for a lavatory, having a flushing cistern in which is arranged a pressure vessel, which has a feed line for water and a discharge valve and in which at least some of the flushing water can be subjected to pressure and can be discharged through the discharge valve for flushing purposes.

2. Description of the Related Art

Conventional flushing cisterns have, as discharge valve, a float valve which is opened, for the purpose of triggering a flushing operation, for example by the actuation of a button. The flushing cistern is arranged above the toilet bowl which is to be flushed and, when the float valve is opened, the flushing water flows, as a result of the gravitational force, through a flushing pipe into the toilet bowl. However, flushing devices in the case of which the flushing water is subjected to pressure in the flushing cistern are also known. During flushing, the flushing water, as a result of the increased pressured, leaves the flushing cistern with an increased amount of energy and, correspondingly, the flushing action is greater.

For example, WO 98/39522 discloses a flushing cistern with a pressure vessel which has a base with a flushing valve. To prepare for a flushing operation, water from a supply line is introduced into the spherical pressure vessel. In addition, air is fed to the pressure vessel. This air is compressed when the water is introduced and builds up a pressure in the vessel. If the flushing valve is opened, then the water flows out of the pressure vessel as a result of the expanding air and, on account of the gravitational force, flows through the open flushing valve into the toilet bowl. As a result of the enhanced flushing action, less water can be used for flushing. The disadvantage with this flushing device is that it has to be designed for a comparatively high pressure, and that it is difficult to set the appropriate pressure in the vessel.

The applicant's WO 95/04196 discloses a flushing device which has a flushing cistern with two water outlets. Through one outlet, of the flushing processes, water is introduced as usual into the toilets bowl. The other outlet is connected to a nozzle which is arranged in a siphon of the toilet bowl and is intended to accelerate the water of the siphon during flushing. The flushing water is not subjected to pressure in the case of this flushing device. A flushing device with two outlets and a nozzle in the siphon involves comparatively high outlay and is not suitable in all cases.

SUMMARY OF THE INVENTION

The object of the invention is to provide a flushing device of the abovementioned type which generates less noise and can be adapted to different toilet bowls. The flushing device according to the invention is characterized by at least one pressure-cylinder unit in which flushing water can be subjected to pressure and can be discharged by way of a spring-loaded pressure piston for flushing purposes. In the cases of the flushing device according to the invention, rather than air being compressed, a spring is subjected to stressing. This has the significant advantage that the flushing capacity can be easily optimized, and adapted to specific toilet bowls, by a corresponding setting of the spring or by additional weights.

According to a development of the invention, it is provided that the pressure piston is locked in a starting position and can be unlocked for flushing purposes. This results in a precisely defined flushing quantity and in a pressure piston subjecting the flushing water to a defined pressure during flushing.

The pressure piston can be unlocked mechanically, pneumatically or electrically.

According to a development of the invention, it is provided that the pressure-cylinder unit accommodates essentially all the flushing water. A pressure-cylinder unit may be integrated in a very space-saving manner in a cistern body. It is preferably provided that the pressure-cylinder unit is formed, at least in certain regions, by an outer wall of the flushing-cistern body. This allows particularly space-saving and cost-effective production.

According to a development of the invention, it is provided that the discharge valve is a servovalve. According to a development of the invention, such a valve may have a diaphragm, which closes the valve under water pressure. This allows flushing to take place essentially without any closing noise.

If the servovalve has an air-extracting member, then flushing can be triggered by this member being actuated. Such triggering is comparatively straightforward and can take place mechanically, pneumatically or electrically.

If the flushing device has two pressure cylinders which are arranged in the flushing cistern, then two different types of flushing are possible. In the case of a half flush, only one of the two pressure-cylinder units is emptied. For a full flush, both pressure-cylinder units are emptied at the same time. The quantity of flushing water is precisely defined in both cases. The two pressure-cylinder units may have the same quantity, or different quantities, of flushing water.

BRIEF DESCRIPTION OF THE DRAWINGS

An exemplary embodiment of the invention is explained in more detail hereinbelow, with reference to the drawing, in which.

DETAILED DESCRIPTION OF THE INVENTION

The flushing device has a flushing cistern 1, which has a cistern body 2 preferably produced from plastic. This cistern body 2 has a top wall 2*a*, a base wall 2*b* and a casing 2*c*. An inspection opening 10 is arranged on the front side, although it is also possible for this opening to be arranged in the top wall 2*a*. Located in the bottom region of the casing 2*c* is a discharge connector 21, which is connected to a toilet bowl (not shown here). The discharge connector 21 leads horizontally into the toilet bowl.

Figure 5:
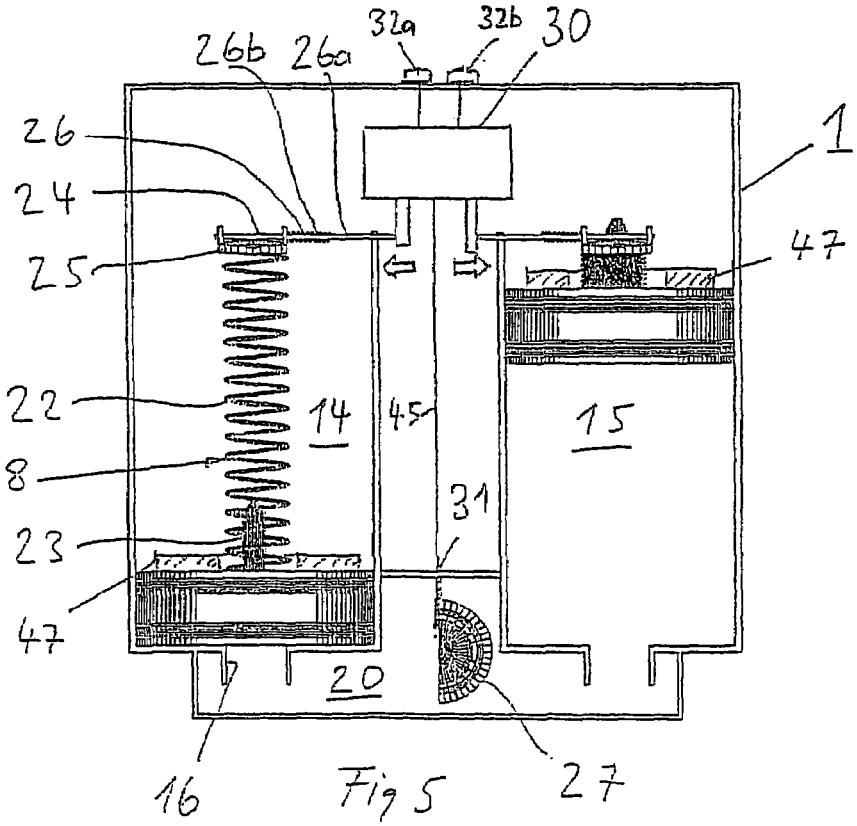
FIG. 5 shows a section according to FIG. 4, but following partial flushing.
Figure 6:
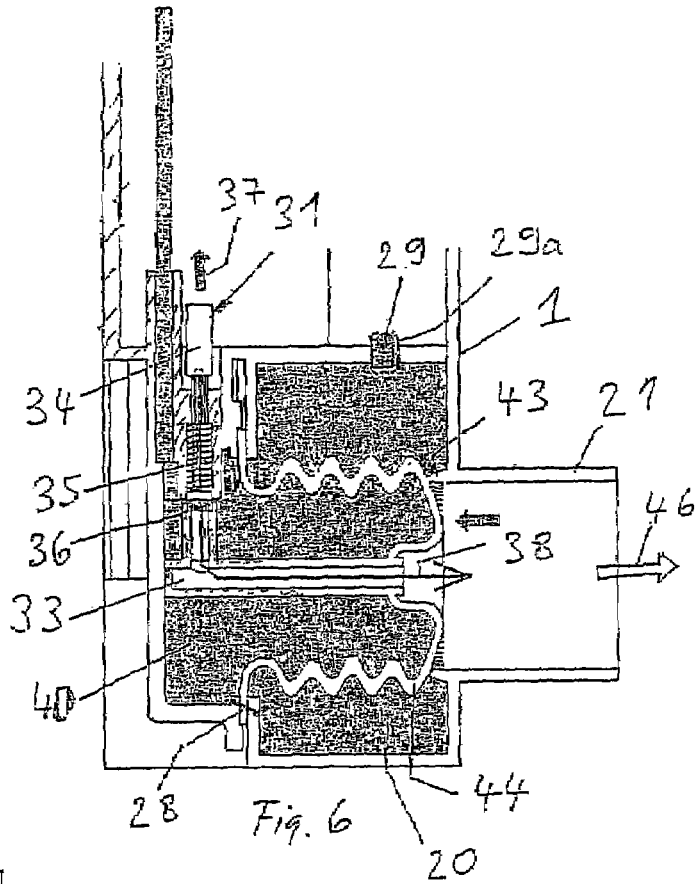
FIGS. 6 and 7 show sections through the discharge valve.

The cistern body 2 contains two pressure-cylinder units 8 and 9, which each have a respective piston 11, 12. The pistons 11 and 12 can each be displaced vertically in a respective pressure chamber 14, 15 and are sealed by sealing rings 13 in relation to a respective cylinder wall 41, 42. These walls 41 and 42 each have a respective base 18, 19, in which a respective through-passage 16, 17 is arranged. These through-passages 16 and 17 lead into a common chamber 20, in which a discharge valve 27 is arranged. The discharge valve 27 is a servovalve and has, as closure body, a bellows 44 comprising a flexible diaphragm. The bellows 44 interacts with a valve seat 43 arranged on the discharge connector 21. As, for example, FIG. 6 shows, the bellows 44 is connected to an air-extraction channel 33, from which air can be extracted by means of an air-extraction member 31. For this purpose, a closure element 34 is raised from a valve seat 36 of the air-extraction channel 33 counter to the restoring force of the spring 35. This can take place, according to FIG. 5, by way of a cable pull 45. It is also conceivable, however, to use some other actuating mechanism. For example, the closure body 34 can be raised pneumatically or by an electric drive. Remote triggering is also conceivable.

Figure 7:
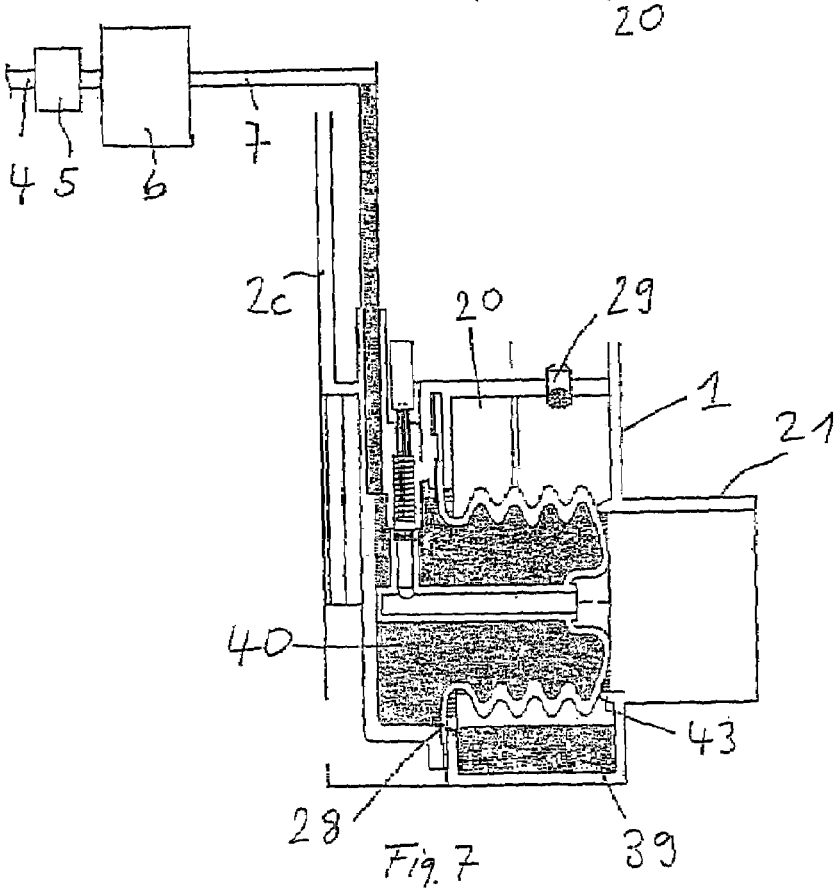

The bellows 44 also forms an inner chamber 40, which is always connected to the chamber 20 via a through-passage 28. The chamber 40 is connected via a water line 7, according to FIG. 7, to an inflow valve 6, which has a regulating valve 5 arranged upstream of it. This regulating valve 5 is connected to a supply line 4. When the inflow valve 6 is open, the inner chamber 40 is connected to the supply line 4.

Figure 1:
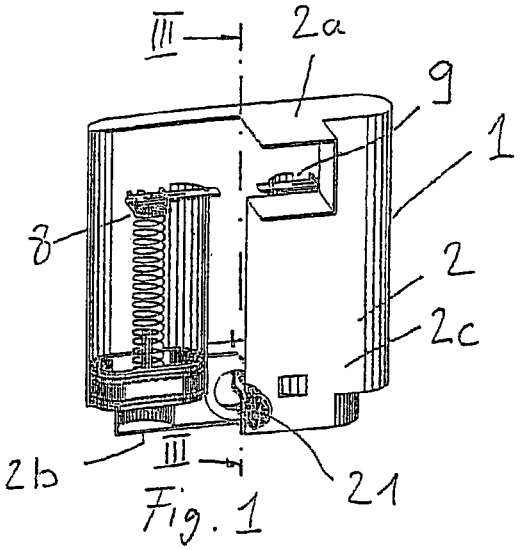
FIG. 1 shows a three-dimensional view of a flushing device, part of which has been cut away.
Figure 2:
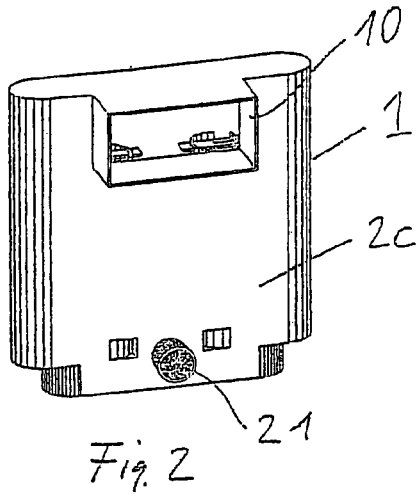
FIG. 2 shows a three-dimensional view of the flushing device according to the invention.
Figure 3:
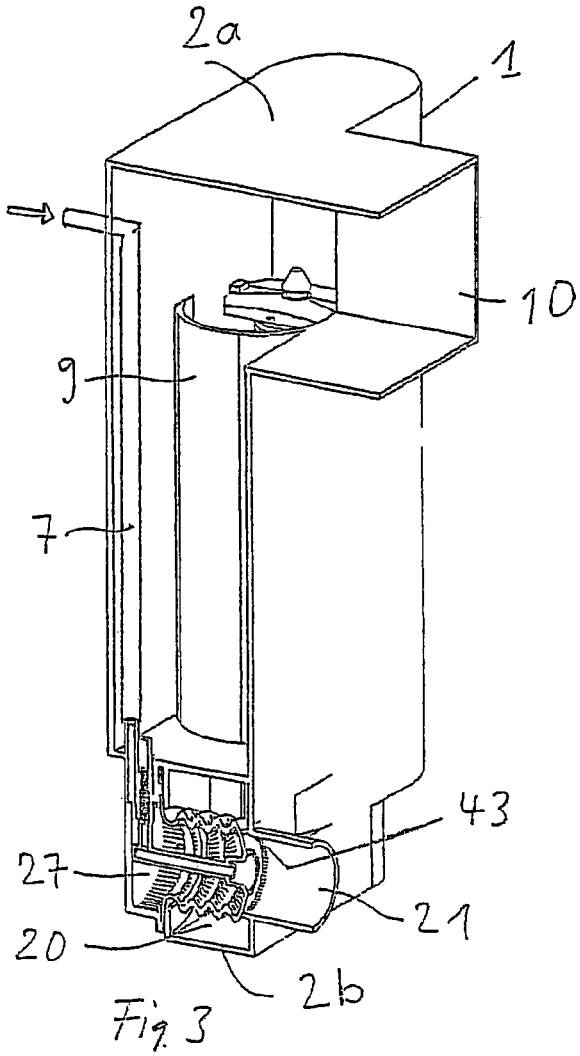
FIG. 3 shows a section along line III—III from FIG. 1.
Figure 4:
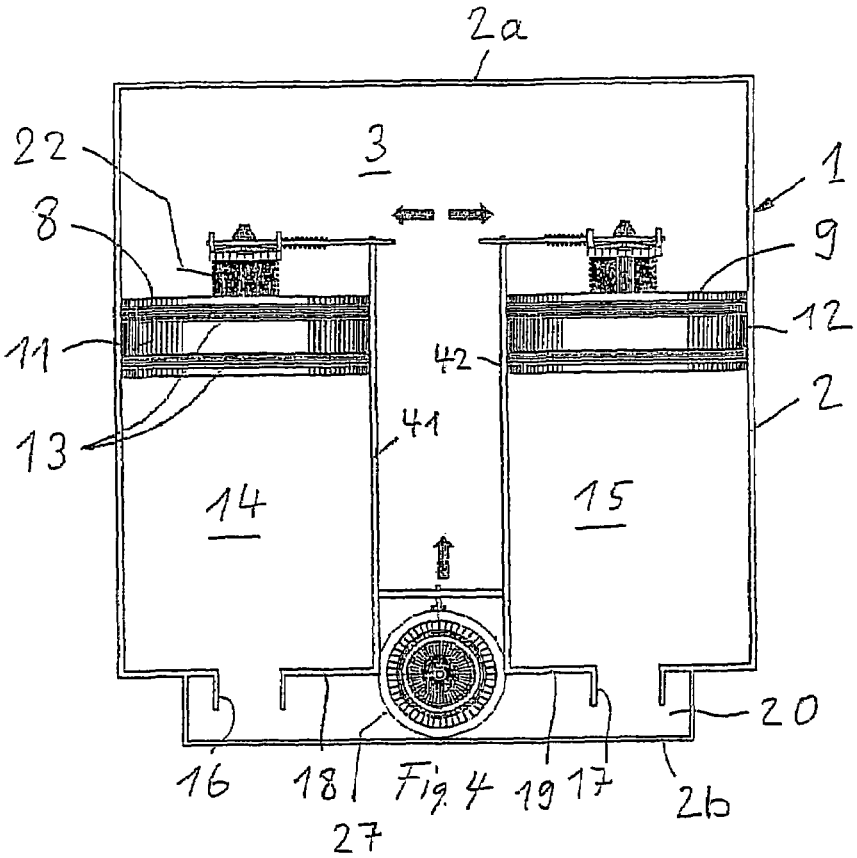
FIG. 4 shows a vertical section through the flushing device according to the invention, individual parts having been omitted for technical reasons.

The pistons 11 and 12 are each provided, on the top side, with a pin 23 which is directed vertically upward and interacts with a securing means 24 in each case in order to arrest the piston 11, 12. The securing means 24 each have a bearing 25, on which locking means 26 are fitted. These locking means 26 may be used to lock the pistons 11 and 12 in a releasable manner in the top, starting position, which is shown in FIG. 4. The locking means 26 are designed such that the pistons 11 and 12 are locked automatically when they reach the starting position. The locking is released by means of an unlocking device 30, which is in engagement with the locking members 26. Unlocking takes place, for example, by a horizontal movement of the locking pin 26*a* counter to the restoring force of a spring 26*b*.

Supported on each of the bearings 25 is a compression spring 22, which butts, at a bottom end, against the piston 11, 12. If the piston 11, 12 in the bottom position, which is shown on the left in FIG. 5, is raised, then the corresponding spring 22 is subjected to stressing. Once the top position has been reached, then the piston 11, 12 is automatically locked.

The operation of the flushing device 1 according to the invention is explained in more detail hereinbelow.

FIG. 4 shows the flushing cistern 1 in the starting position. The two pressure chambers 14 and 15 are filled with flushing water. The springs 21 are subjected to stressing and the pistons 11 and 12 are locked in a top, starting position. The discharge valve 27 and the air-extraction valve 31 are closed. The inflow valve 6 is likewise closed.

In order to trigger a partial flushing operation, in the case of which flushing takes place, for example, with three liters of water, the unlocking device 30 is activated, by virtue of the button 32*a* which is shown in FIG. 5 being pushed, such that the catch 26*a* of the pressure-cylinder unit 8 is displaced and the piston 11 is thus unlocked. The piston 11 is thus freed and subjected to loading by the force of the spring 22. At the same time as the cap 26*a* is displaced, the closure body 34 of the air-extraction valve 31 is raised by way of the cable pulll 45. As a result, the pressure in the chamber 40 drops and the difference in pressure in relation to the chamber 20 causes the bellows 44 to be raised off from the valve seat 43. The water in the chamber 20 can thus flow through the discharge connector 21 into the flushing pipe (not shown). Since, as has been mentioned above, the chamber 20 is connected to the pressure chamber 14 via the opening 26, this outflowing water is subjected to pressure by the piston 11 and/or the spring 22 as it is relieved of stressing. The piston 11 moves downwards into the position which is shown in FIG. 5, flushing water is simultaneously being discharged out of the chamber 14, through the chamber 20 and the discharge connector 21. The water here, according to FIG. 6, flows horizontally, in the direction of the arrow 46, into a flushing bend (not shown here) or directly into the flushing channel of a lavatory bowl. Such direct horizontal introduction of flushing water into the toilet bowl is advantageous since no energy is lost by deflection around a bend.

If the piston 1 is in the position which is shown in FIG. 5, then the flushing operation is at an end. Remaining in the chamber 20 is by the residual water 39, shown in FIG. 7, which is connected to the water in the chamber 40 via the through-passage 28. When the chamber 20 is emptied, air is drawn in out of a chamber 3 via the air-extraction valve 29. The drop in pressure in the chamber 40 causes the inflow valve 6 to open automatically, and the supply line 4 is thus connected to the line 7. Water thus flows through the line 7 into the chamber 40, and via the through-passage 28 into the chamber 20. The air present in the chamber 20 is displaced into the chamber 3 by the air-extraction valve 29. If the chamber 20 has been filled with water, then this water passes through the through-passage 16 to the piston 11 and moves the latter upwards, on account of the water pressure, counter to the restoring force of the spring 22 until it butts against the bearing 25 and is locked. If a predetermined cistern pressure has been reached, then the regulating valve 5 closes the filling valve 6. The piston 11 is thus in the starting position again and both pressure chambers 14 and 15 and the chamber 20 are filled with water. Even as the refilling operation is initiated, the bellows 44 moves into the closed position on account of the increasing pressure in the chamber 40, and thus butts against the valve seat 43. Once air initially present in the chamber 20 has been displaced, the air-extraction valve 29 closes on account of the buoyancy of a float 29*a* in the water. The system pressure in the refilled flushing cistern is, for example, and preferably, approximately 0.2 bar.

For a further flushing operation, then, it is possible to make a selection between partial flushing, in the case of which merely the pressure chamber 14 is emptied, and full flushing, in the case of which the pressure chamber 14 and the pressure chamber 15 are emptied. Full flushing may be triggered using the button 32*b* (FIG. 5). If this button 32*b* is actuated, then the unlocking device 30 unlocks both pistons 11 and 12 at the same time. These move downward and displace the water out of the pressure chambers 14 and 15. Since the air-extraction device 31 is actuated at the same time via the cable pull 45, the discharge valve 27 opens and the water is discharged horizontally, in the direction of the arrow 46, through the discharge connector 21. Since both pressure chambers 14 and 15 are emptied, the quantity of water discharged is double the quantity for the partial flushing explained above. The refilling operation takes place essentially as has been explained above. In the event of a drop in pressure, the inflow valve 6 thus opens automatically and water flows, via the line 7, into the chamber 40 and, through the through-passage 28, into the chamber 20. Once the air in the chamber has been displaced and the air-extraction valve 29 has been closed, then, as a result of the water pressure, both pistons 11 and 12 are raised at the same time and moved into the locked, starting position. When the system pressure is reached, the upstream regulating valve 5 closes the inflow valve 6. The flushing cistern 1 is thus ready for a further flushing operation. The flushing device, as has been explained, has the advantage that it can be optimized and adapted to specific toilet bowls. For this purpose, it is possible, for example, for the springs 22 to be exchanged for stronger or weaker springs. In addition, it is possible, for example, for annular weights 47 to be positioned on the pistons 11 and 12 according to FIG. 5. Such weights 47 increase the pressure of the water in the pressure chambers 14 and 15 and, correspondingly, these pressure chambers 14 and 15 are emptied under higher pressure, and correspondingly more quickly, during flushing. The regulating valve 5 is adapted to this modified cistern pressure.

The invention claimed is:

1. A flushing device for a lavatory, comprising a flushing cistern in which is arranged at least one pressure vessel, the pressure vessel having a feed line for water and a discharge valve, wherein at least some of flushing water is subjected to pressure and is discharged through the discharge valve for flushing purposes, and at least one pressure-cylinder unit has the flushing water subjected to pressure and discharged by way of a spring-force-loaded pressure piston for flushing purposes, the piston has an upper starting and lower position, wherein the pressure piston is locked in the upper starting position and is unlocked for flushing purposes.

2. The device as claimed in claim 1, wherein the pressure-cylinder unit subjects all the flushing water to pressure.

3. The device as claimed in claim 1, wherein the pressure-cylinder unit is formed, at least in certain regions, by an outer wall of a flushing-cistern body.

4. The device as claimed in claim 1, wherein the pressure-cylinder unit has, in a base, a through-passage opening, the through-passage opening opens out into a chamber including the discharge valve.

5. The device as claimed in claim 1, wherein the discharge valve is a servovalve.

6. The device as claimed in claim 5, wherein the discharge valve has a flexible diaphragm, the diaphragm closes the discharge valve under water pressure.

7. The device as claimed in claim 6, wherein the diaphragm is designed as a folding bellows.

8. The device as claimed in claim 5, wherein the discharge valve is triggered by actuation of an air-extraction member.

9. The device as claimed in claim 1, further including an inflow valve connected to a supply line and opening automatically in an event of a drop in pressure.

10. The device as claimed in claim 9, wherein the inflow valve is assigned a pressure-regulating valve, the pressure-regulating valve closes the inflow valve automatically in a case of a predetermined system pressure.

11. The device as claimed in claim 1, wherein the discharge valve opens out into a horizontally extending discharge connector.

12. The device as claimed in claim 1, wherein the discharge valve has a through-passage connecting an inner chamber to an outer chamber, and during a refilling operation, water is introduced through the through-passage into the outer chamber and into at least one pressure chamber.

13. The device as claimed in claim 1, further including two pressure-cylinder units actuated independently of one another.

14. The device as claimed in claim 13, wherein an actuating means optionally triggers partial flushing or full flushing, where one pressure-cylinder unit is actuated in a case of partial flushing.

15. A flushing device for a lavatory, comprising a flushing cistern in which is arranged at least one pressure vessel, the pressure vessel having a feed line for water and a discharge valve, wherein at least some of flushing water is subjected to pressure and is discharged through the discharge valve for flushing purposes, and at least one pressure-cylinder unit has the flushing water subjected to pressure and discharged by way of a spring-force-loaded pressure piston for flushing purposes, wherein the discharge valve is a servovalve, wherein the discharge valve is triggered by actuation of an air-extraction member, and wherein air is extracted via a channel, the channel opens out into a discharge connector of the flushing cistern.

* * * * *